United States Patent [19]

Strandell

[11] 4,363,234

[45] Dec. 14, 1982

[54] METHOD AND APPARATUS FOR FORGING SECTIONS

[76] Inventor: Per-Olof Strandell, Bockstigen 3, 183 51 Täby, Sweden

[21] Appl. No.: 212,126

[22] Filed: Dec. 2, 1980

[30] Foreign Application Priority Data

Dec. 10, 1979 [SE] Sweden ..... 7910161

[51] Int. Cl.[3] ..... B21D 41/00

[52] U.S. Cl. ..... 72/402

[58] Field of Search ..... 72/403, 402, 377, 353, 72/356, 189, 394

[56] References Cited

U.S. PATENT DOCUMENTS 3,580,032 5/1971 Stone ..... 72/199

FOREIGN PATENT DOCUMENTS 662372 5/1979 U.S.S.R. ..... 72/402

740372 2/1980 U.S.S.R. ..... 72/402

*Primary Examiner*—Gene P. Crosby

*Attorney, Agent, or Firm*—Le Blanc, Nolan, Shur & Nies

[57] ABSTRACT

A method and an apparatus, FIG. 1, for manufacturing sections (9,10,11), preferably for manufacturing beam preforms.

The method is characterized in that a blank (7) with rectangular or square cross-section is forged between a pair of web tools (1,2), in that the web tools (1,2) are moved to and from each other for forming a web portion (9) on said blank (7), and is forged against flange tools (3,4), in that the tools are moved to and from the web tools (1,2) in a direction perpendicular to the direction of movement of the web tools. The blank portion located between the web tools (1,2) and respective flange tool (3,4) is upset to form flange portions (10,11) between the flange tool (3,4) and respective sides (1',2',1'',2'') of the web tools (1,2).

The method further is characterized in that the blank (7) successively and in steps is fed in between the web tools (1,2) and successively and in steps is deformed by means of said tools (1,2,3,4).

10 Claims, 12 Drawing Figures

METHOD AND APPARATUS FOR FORGING SECTIONS

Figure 1:
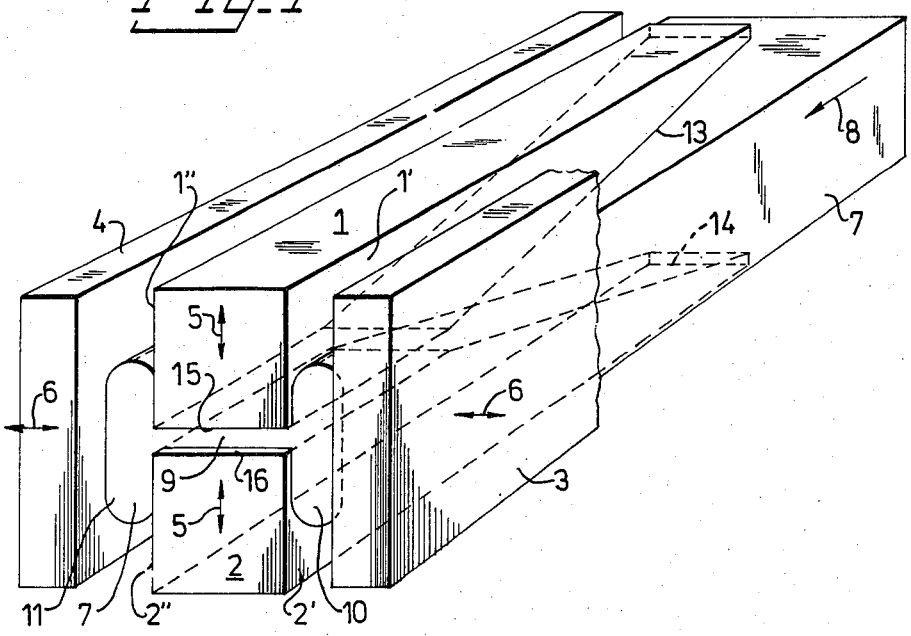

This invention relates to a method and an apparatus for forging sections, preferably for forging a beam preform intended to be given finished form in a subsequent rolling operation.

Beams and similar bar products, for example angle bars, U-bars and T-bars, conventionally are manufactured by rolling or extrusion. Rolling is proceeded from an ingot or a rough blank obtained by continuous casting. This blank, which has square or substantially square cross-section, first is rolled to a so-called pre-section, which then is rolled in a finishing train to a finished section bar or beam.

One way of reducing the number of rolling steps from a blank to a finished product is to cast a pre-section in a continuous casting process. Such continuous casting of pre-sections, however, presupposes very long series for being profitable, because tedious adjustments must be made and the casting be interrupted when a continuous cast dimension is to be changed. According to experts in continuous casting, the total demand of continuous casting machines for casting beam sections worldwide is about five machines.

Mills for the rolling of section bars, therefore, almost exclusively are bound to roll beams from ingots or cast square or rectangular "blooms" by continuous casting.

As an example of conventional technique, the following data for rolling a HEB-300 beam can be stated:

Rolling of a pre-section from ingot requires 29 passes in a rolling mill, proceeding from blooms 16 passes, and proceeding from continuous cast section 5 passes. 7 further passes are required for finishing rolling.

When rolling a HEB-600 beam, it proceeds from an ingot with cross-section 730×730 mm. Rolling of a pre-section here requires 27 passes and for finishing rolling 13 additional passes. The starting dimension and the number of passes, however, vary slightly from one mill to another. The deviations, however, are small.

The sectional area of the starting blank of this example is 5260 $cm^2$, and the sectional area of the finished beam is only 270 $cm^2$. This implies a stretching (elongation at rolling) by 20 times. This is a normal value, but stretchings up to 50 times do occur.

The reason why the rolling of sections with small wall thickness must proceed from such large dimensions is, that when the thin web portion is being rolled-down also material from the portions intended to form the flanges is drawn along. Therefore, the blank dimension must be chosen greater than the flange width.

For every beam or other section to be rolled, thus, a considerable number of grooved rolls are required. In addition, well-adjusted guides are required to guide the blank into and out of the rolling gap. A conventional rolling mill for section bars and beams, therefore, must keep a very large stock of rolls and guide equipment, which involves high costs. Even for a modern section rolling mill the building area for these stores exceed substantially the rolling mill area proper inclusive of adjustage.

A further essential disadvantage is the great number of roll changings, implying considerable capacity loss and costs. The degree of usefulness at the rolling of section bars, therefore, is relatively low.

The present invention renders possible among other things a substantially increased utilization of the equipment and a substantially reduced demand of rolls and guide means. This implies considerable gains in capacity and operation economy.

The present invention has the object of providing a method of forging sections, preferably preforms for beams and other sections, preferably for manufacturing beam preforms.

The invention is characterized in that a blank with rectangular or square section is forged between a pair of web tools, in that the web tools are moved to and from each other to form a web portion of said blank, and is forged against one or two flange tools, in that said tool or tools are moved to and from the web tools in a direction perpendicular to the direction of web tool movement so as to upset the blank portion located between the web tools and respective flange tool to form one and, respectively, two flange portions between the flange tools and respective sides of the web tools, and that the blank successively and in steps is fed in between the web tools and successively and in steps is deformed by said tools.

The present invention also has the object to provide an apparatus for forging sections, preferably so-called beam preforms, which apparatus is characterized in that a pair of web tools are arranged so as by means of a press, forging machine or the like of a type known per se to be moved to and from each other, and upon movement to each other form between themselves a gap or space of predetermined size and shape for forming a web portion of said section, and that one or two flange tools are provided, each of which is arranged so as by means of a press, forging machine or the like of a type known per se to be moved to and from said web tools in a direction substantially perpendicular to the direction of web tool movement, and upon movement to the web tools between themselves and the web tools to form a gap or a space of predetermined size and shape, that the height of the flange tools substantially exceeds the smallest gap occurring between the web tools, and the side surfaces of the web tools facing to the flange tools together with the respective flange tool form a tool pair capable to upset a flange portion at said section, between which tools a blank is intended to be fed-in successively and in steps and be deformed successively and in steps.

Figure 2:
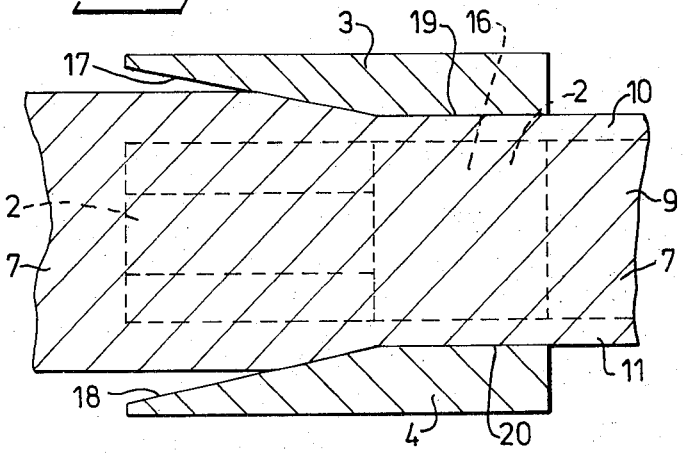
Figure 3:
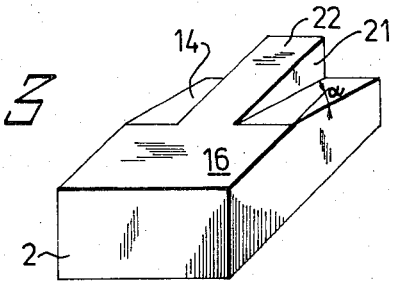
Figure 4A:
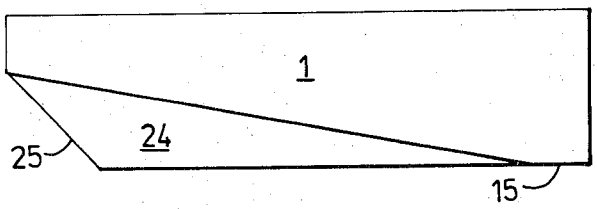
Figure 4B:
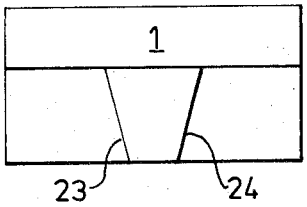
Figure 5A:
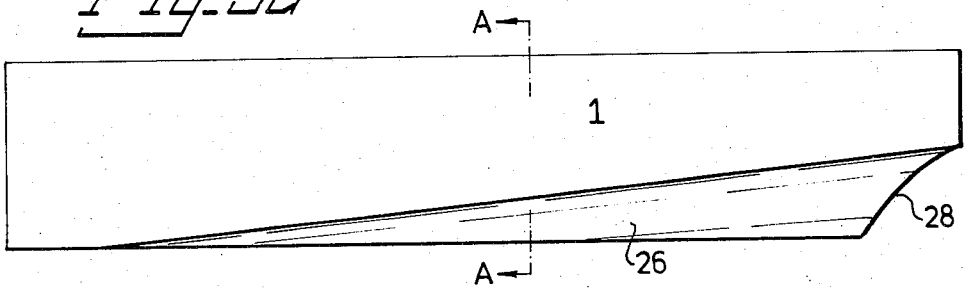
Figure 5B:
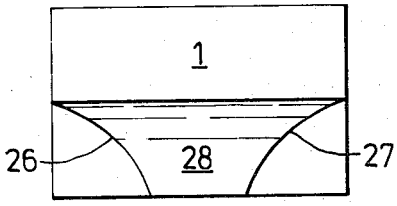
Figure 5C:
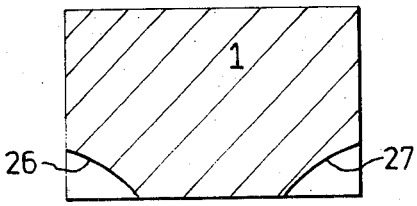
Figure 6:
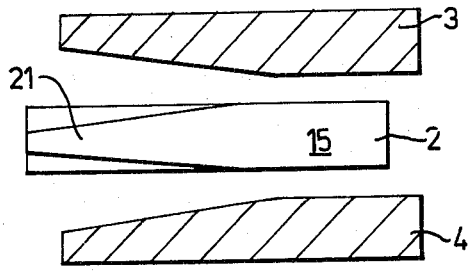
Figure 7A:
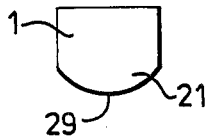
Figure 7B:
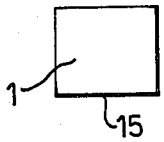
Figure 8:
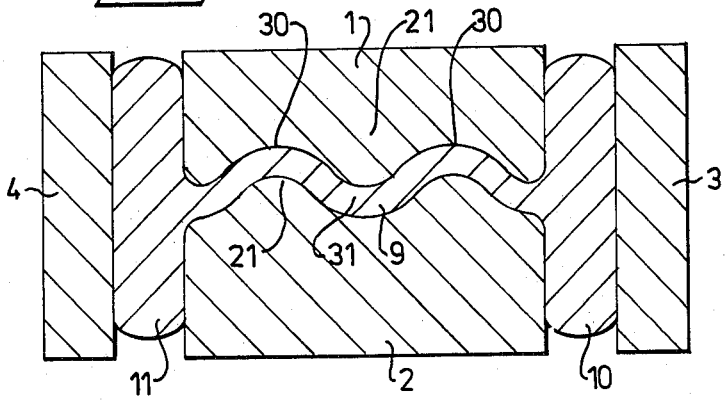

The invention is described in greater detail in the following, with reference to the accompanying drawings, in which FIG. 1 is a schematic perspective view of a tool design according to the invention, FIG. 2 is a horizontal section centrally between two web tools of an embodiment according to FIG. 3, FIG. 3 is a perspective view of an embodiment of a web tool, FIG. 4*a* is a lateral view of a further embodiment of a web tool, FIG. 4*b* is a view of the tool according to FIG. 4*a* seen from the left in FIG. 4*a*, FIG. 5*a* is a lateral view of still another embodiment of a web tool, FIG. 5*b* is a view from the right of the web tool according to FIG. 5*a*, FIG. 5*c* is a section A—A according to FIG. 5*a*, FIG. 6 is a section centrally between two web tools, FIGS. 7*a*, 7*b* are views of an embodiment of a ridge seen from the feed-in and, respectively, feed-out end of the web tool, FIG. 8 is a sectional view of an embodiment of web tools for forging a wide web between narrow tools.

The new technique according to the invention of forging sections or preforms implies, that a relatively thin, but wide blank is formed to beam or section shape by upsetting a flange or flanges at the same time as the web is formed by forging down.

The upsetting of the flanges implies that a blank dimension can be chosen which is thinner than the flange height. This technique implies also that it is proceeded from very small blank dimensions. A blank area suitable for the method is 1.5 to 2 times the area of the product delivered from the forging. A beam HEB-300 can according to the invention be manufactured in the way as follows. Proceeding from a blank with the cross-sectional dimensions $433\times207=89{,}630$ mm$^2$ a preform is forged, the web of which has the cross-sectional dimensions $262\times27{,}5$ mm, and the flanges have the cross-sectional dimensions $330\times57$ mm, the total cross-sectional area being about 44,825 mm$^2$.

This preform is passed through a rolling operation comprising seven passes, resulting in a finished beam with a web having the cross-sectional dimensions $300\times11$ mm, and with flanges having the cross-sectional dimensions $300\times19$ mm, the total cross-sectional area being about 14,700 mm$^2$.

The area of the blank in this case is twice that of the pre-section and the stretching, thus, in twice as great. The number of rolling steps, thus, by the technique according to the invention has decreased from 23 to 7 when proceeding from a "bloom" cast by continuous casting.

This forging technique suitably is utilized for the forging of preforms while maintaining a finishing train for rolling the pre-sections. The technique alternatively can be utilized for continuing the forging-down and thereby to reduce the number of passes in the finishing train.

The technique according to the invention also can be applied to forge a finished beam or other section directly from a flat dimension when the desired capacity is relatively small.

The simultaneous shaping of flanges and webs must be adapted so that the stretching in flanges and web portions is equal or almost equal, as otherwise the risk of faults will arise.

From a qualitative aspect, this method has the advantage that internal faults, such as voids, are eliminated to a greater extent than at rolling, and that a better fibre structure is obtained where the fibre structure affects the strength properties of the product, i.e. the beam.

The principle of an apparatus for carrying out said method is shown in FIG. 1, in which an upper web tool is designated by 1, a lower web tool by 2, a first flange tool by 3 and a second flange tool by 4. The web tools 1,2 are movable in a vertical direction as indicated by the arrows 5. The flange tools are movable in a horizontal direction as indicated by the arrows 6. 7 designates a blank being forged.

The said movement of the tools 1,2,3,4 is intended to be effected by a forging press or presses, a forging machine or corresponding machine known per se (not shown). The press or presses are connected to the tools so that the web tools 1,2 and, respectively, the flange tools 3,4 can be moved from and to each other. The movement of the web tools 1,2 may be depending or independing on the movement of the flange tools 3,4. The press or presses are not described in detail, as they are not part of the present invention.

Referring to FIG. 1, the present method proceeds in principle as follows. The blank 7 with rectangular cross-section is stepped in between web and flange tools in the direction of the arrow 8. At each advancing step the tools 1–4 are moved from each other, so that the blank 7 can be advanced freely. After each advancement the web tools 1,2 and, respectively, flange tools 3,4 are moved in the direction toward each other, whereby a web portion 9 is formed in that the thickness of the blank 7 is reduced by the web tools 1,2 while two flange portions 10,11 are formed in that the edge portions of the blank 7 are upset by the flange tools 3,4, in such a manner, that one flange portion is upset between each flange tool and the side surfaces 1', 2' and, respectively, 1'', 2'' of the web tools.

All of the tools 1–4 can be moving simultaneously. Alternatively the web tools 1,2 and, respectively, the flange tools 3,4 can be moving successively after each other.

The invention also comprises an embodiment with only one movable flange tool. In that case only one flange is upset, as for example at the manufacture of a T-section.

According to the present invention, at least the web tools 1,2 are designed so as to have an inclined entrance part, which in FIG. 1 is shown schematically as a plane part 13,14. Said part joins with a plane outlet part 15,16 lying perpendicularly to the direction of the movement of the tools 1,2. Between the parts 15,16, thus the final thickness of the web portion 9 is formed.

By means of this special design, the initial height of the blank 7 will successively decrease during the successive stepwise feeding between the tools 1,2. This fact, in combination with the fact that the part of the web tools 1,2 situated at the feeding entrance does not, according to the method, deform the blank 7, means that a successive, smooth deformation takes place, and no surface discontinuities, such as steps, are formed.

For the same reason, also the flange tools 3,4 are formed with an inclined entrance part 17,18 as shown in FIG. 2.

The successive reduction of the blank thickness at the forging between the web tools 1,2 yields a successive increase of the width of the blank 7. The material which, thus, successively is pressed out in the direction to the flange tools, is upset successively, owing to the design of the flange tools 3,4, to form said flange portions 10,11.

By varying the angle $\alpha$ between the entrance parts 13, 14, 17, 18 and the outlet parts 15, 16, 19,20 of the web tools 1,2 and/or flange tools 3,4, the reduction degree at each deformation can be varied. By varying the step length at the stepped feed-in of the blank, the total deformation imparted to the blank 7 at each deformation step can be varied.

The web tools 1,2 can be designed with plane inclined entrance part 13,14 as described above. This design, however, involves limited possibilities of controlling the deformation so, that the stretching of web 9 and flanges 10,11 will be equal or almost equal. At this embodiment, the stretching in the web portion 9 exceeds substantially that in the flange portions 10,11. This results in great shear stresses in the border portion between the web portion 9 and each flange portion 10,11, whereby defects such as cracks can arise.

According to a preferred embodiment, the web tools 1,2 are constructed in principle as shown in FIG. 3. The said entrance part 13,14 (seen in FIG. 1) comprises a central ridge 21 (as depicted in FIG. 3), the longitudinal direction of which is in parallel with the direction, in which the flank 7 is intended to be advanced. The upper surface 22 of the ridge 21 is plane and preferably in parallel with said plane outlet part 15,16 and joins with said outlet part where the entrance part 13,14 joins with the outlet part 15,16. Owing to this design, the stretching in the web portion 9 decreases, and the stretching can be varied by varying the ridge design, primarily by varying its width. The reduced stretching yields a corresponding increase in width. Hereby the aforesaid disadvantages are eliminated which are caused by too great a stretching in the web portion, and simultaneously flanges with a greater height can be manufactured.

In order to prevent faults, such as notches or the like, in the forged section 9,10,11, the ridge 21 should not be designed with strongly inclined side surfaces, as shown in FIG. 3, but the side surfaces 23,24 of the ridge and its entrance side 25 should be designed with a certain distinctive inclination as appears from the preferred embodiment shown in FIGS. 4*a*, 4*b*. The ridge 21 preferably is designed with curved sides 26,27 and curved entrance side 28, FIGS. 5*a,b,c*, instead of with plane sides as shown in FIGS. 4*a,b*.

A parameter, in addition to the design of the web tools and flange tools, for controlling the forging process is a displacement of the web tools 1,2 relative to the flange tools 3,4 rearward in relation to the direction of advancement, as appears from FIG. 6. Said displacement preferably increases with increasing degree of rectangularity of the cross-section of the blank.

The shape of the ridge 21 can be varied within the scope of the invention and, for example, can be designed with a rounded entrance section 29, which successively transforms to the plane outlet part 15,16 as shown in FIGS. 6*a,b* where the ridge 21 extends over the entire width of the web tool 1.

The outlet part 15,16 of each web tool may also be given curved wavy shape 30, which reduces the force required for the deformation. For the forging of wide beams, it can be designed as shown in FIG. 8. For narrow beams one wave 30 is sufficient. This curved shape is particularly suitable for the forging of sections with small web thickness, which is desired when the section hereby is of lighter weight without appreciably loosing in rigidity. The said outlet part 15, 16, thus, is wave-shaped, preferably sinus-shaped, where the wave shape 30 of the two parts 15,16 correspond to each other so that a wave-shaped gap 31 of constant height is formed between the tools 1,2, where the wave troughs and wave crests extend in the longitudinal direction of the web tools 1,2.

The method and the apparatus according to the invention, thus, render it possible that the stretching and increase in width at the manufacture of sections and preforms can be controlled by the design of the tools. This is to a very small extent the case at rolling, because the round shape of the rolls implies a locking from a geometric aspect. The degree of stretching from blank to section, therefore, can be reduced substantially by applying the method, which decreases the extent of working and involves savings.

It is, of course, possible to imagine a plurality of tool designs adapted to definite products or preforms, without abandoning the idea of the invention.

Beams and other sections or preforms for said products, thus, can be manufactured advantageously by the method and apparatus described. It is to be pointed out that the method, of course, can be applied so that the blank is caused to pass several times through the same tool set whereby the blank is imparted with an additional deformation at each new passage.

The method and apparatus also can be imagined to be used for widening the blank, where the widened blanks are intended to be worked further by means of hot rolling to strip or sheet. The widening is effected by reducing the blank thickness preferably by means of said web tools, while the flange tools are used for a relatively slight deformation, the object of which is to adjust the width and the edge design. In this way it is possible to obtain by means of a definite tool set different blank widths from a definite blank dimension. The width can be controlled by means of the reduction in height, i.e. the thickness reduction of the blank, as the width increase increases with increasing height reduction at the passage between the tools. By means of some different tool sets it is, thus, possible to manufacture blanks with widths within a relative large interval.

The invention, thus, must not be regarded restricted to the aforesaid embodiments, but can be varied within the scope of the attached claims.

I claim:

1. A method of manufacturing sections, preferably beam preforms, where a blank with preferably rectangular cross-section is forged between a pair of web tools moved to and from each other for forming a web portion on said blank, and is simultaneously forged between at least one flange tool and the web tools, where each flange tool is moved to and from the web tools in a direction perpendicular to the direction of movement of the web tools (1, 2) for upsetting the blank portion located between the web tools and the flange tool to form a flange portion between the flange tool and the sides of the web tools, and wherein the blank successively and in steps is fed in between the web tools (1) and successively and in steps is deformed by means of said web and flange tools, characterized in that: forging, at least partly, is performed by means of simultaneous movement of the web tools and said at least one flange tool and in that the material of the width of the blank is moved laterally by forging the blank (7) between two opposing ridges on the web tools, each ridge on each web tool including an inclined entrance part of the associated web tool, the initial forging by said ridges taking place before the blank is deformed by the residual portion of said inclined entrance parts, the longitudinal direction of the ridge being in parallel with the direction, in which the blank is advanced.

2. A method as defined in claim 1, characterized in that said portion of the blank which is located between the web tools and the at least one flange tool is upset continuously in the feed-in direction to a flange portion by means of an inclined entrance part provided on the flange tool.

3. A method as defined in claim 1, characterized in that a blank with an original width, which is 1.5 to four, and preferably two to three times greater than the original height of the blank is deformed between said tools.

4. A method as defined in claim 1, wherein two flange tools are provided, one on each side of the web tools and all tools are moved simultaneously to forge a web portion and a flange portion on each side of the web portion.

5. An apparatus for manufacturing sections, preferably so-called beam preforms, from blanks with preferably rectangular section, where two web tools are provided, which by means of a press, forging machine or the like of a type known per se are moved to and from each other and at the limit of movement toward each other form between themselves a space of predetermined size and shape for forming a web portion on said section, and that at least one flange tool is provided, which by means of a press, forging machine or the like of a type known per se is moved to and from said web tools in a direction substantially perpendicular to the direction of movement of the web tools, and at the limit of movement toward the web tools form between the flange tool and the web tools a space of predetermined size and shape, where the height of the flange tool forging face is substantially greater than the smallest gap occurring between the web tools, and the side surfaces of the web tools which face the flange tool together with the flange tool form a tool pair intended to upset a flange portion on said section, and between which web and flange tools a blank is intended to be fed in successively and in steps and be deformed by forging successively and in steps, the apparatus comprising: said tools arranged to be moved simultaneously, at least during part of each step of the blank; the side of each web tool which faces the other web tool includes an inclined entrance part which in the longitudinal direction of the web tool transforms to a plane containing an outlet part, the outlet parts of the web tools being parallel, and the distance between said entrance parts being greater than the distance between said plane outlet parts; and a ridge projects from said inclined entrance part of each web tool, said ridge being located centrally and extending from the transition of said entrance part to said outlet part along substantially the entire length of the entrance part.

6. An apparatus as defined in claim 5, wherein the side of each flange tool facing the sides of the web tools includes an inclined entrance part which transforms to an outlet part where the distance between said flange tool outlet part and said web tool side surfaces is less than the distance between said flange tool inclined entrance part and said web tool side surfaces.

7. An apparatus as defined in claim 5, wherein the side surfaces of each ridge at its entrance end, combine with said inclined web tool entrance part providing an inclination with said inclined web tool entrance part so that the width of the ridge increases as the height of the ridge decreases over the length of the web tool entrance part.

8. An apparatus as defined in claim 7, wherein the inclination of the surfaces of the ridge joining with said inclined entrance web tool part has a curved contour so that the width of the ridge increases as the height of the ridge decreases over the length of the web tool entrance part.

9. An apparatus as defined in claim 5, having two of said flange tools, one on each of the sides of said web tools.

10. An apparatus as defined in claim 5, wherein the outlet part of a said web tool is wave-shaped, preferably sinus-shaped, and the opposed web tool has a complementary wave-shape, so that a wave-shaped gap of constant height is formed between the tools, the wave troughs and wave crests extending in the longitudinal direction of the web tools.

* * * * *